US005209143A

United States Patent [19]

Sweet

[11] Patent Number: 5,209,143

[45] Date of Patent: May 11, 1993

[54] REVERSIBLE HOSE CLAMP TOOL

[76] Inventor: Paul A. Sweet, Rte. One; Box 150, New Madrid, Mo. 63819

[21] Appl. No.: 896,417

[22] Filed: Jun. 10, 1992

Related U.S. Application Data

[63] Continuation-in-part of Ser. No. 736,438, Jul. 26, 1991, abandoned.

[51] Int. Cl.[5] ..... B25B 27/00

[52] U.S. Cl. ..... 81/9.3; 29/229; 29/243.56; 29/268; 81/424.5; 81/427.5; 81/415

[58] Field of Search ..... 81/9.3, 424.5, 300, 81/488, 485, 486, 415, 427.5; 29/229, 243.56, 268, 225, 270; 403/267

[56] References Cited

U.S. PATENT DOCUMENTS

| | | | |
|---|---|---|---|
| 891,509 | 6/1908 | Tanner | 81/424.5 |
| 2,677,982 | 5/1954 | Arras et al. | 81/9.3 |
| 2,898,789 | 8/1959 | Meese | 81/9.3 |
| 4,162,640 | 7/1979 | Arnold | 81/9.3 |
| 4,219,919 | 9/1980 | Fischbein et al. | 81/424.5 |

FOREIGN PATENT DOCUMENTS

| | | | |
|---|---|---|---|
| 3716583 | 12/1988 | Fed. Rep. of Germany | 403/267 |

*Primary Examiner*—Roscoe V. Parker
*Attorney, Agent, or Firm*—Allegretti & Witcoff, Ltd.

[57] ABSTRACT

A reversible hose clamp tool for use with double ring spring wire hose clamps comprised of a pair of main members and a pivot which resembles pliers and operates similarly thereto. Each main member is an elongated tool member comprised of a handle section, a pivot section and a jaw section. The handle section is elongated to provide leverage to ease operation and to provide comfort to the user. If desired, it may be patterned, knurled or otherwise treated to provide an improved gripping surface or can be provided with a cushion coating which provides a protective grip for the handle and a more comfortable grip for the user. The pivot section contains a pivot bore through which is placed a pivot pin to pivotally join the pair of main members. The jaw section has a head end and sides. First and second generally rectangular cutouts, are disposed along an inside front edge of head end and laterally through its sides of the jaw sections. The first generally rectangular cutouts are designed to receive the first end or loop end of double ring spring wire hose clamp. The second generally rectangular cutouts are designed to receive the second end or ears of the double ring spring wire hose clamp. The device allows the diameter of the hose clamp to be increased when the pair of handle sections of the elongated tool member are compressed.

6 Claims, 3 Drawing Sheets

REVERSIBLE HOSE CLAMP TOOL

RELATED APPLICATION

This is a continuation-in-part of U.S. application Ser. No. 07/736,438 filed Jul. 26, 1991, entitled "HOSE CLAMP TOOL" and now abandoned.

FIELD OF THE INVENTION

The present invention relates to plier type tools and more particularly, to plier type tools used in connection with the installation or removal of a spring wire type of hose clamp. Such hose clamps are generally in the shape of a double wire ring having a loop end bent radially outward and an end with the two projections of the wire ring bent radially upward through the loop of the ring end.

BACKGROUND OF THE INVENTION

Presently a variety of pliers and several types of hose clamp pliers are available on the market. In general, hose clamp pliers are designed for the installation and/or removal of spring wire hose clamps. The type of spring wire hose clamp for which these pliers are typically designed is a single wire ring having overlapping ends which terminate in ears that are bent radially upward. It will be understood that when the ears are squeezed together, the clamp will expand so that it may be placed around the hose and when the ears are released, the clamp will tighten around the hose thereby completing the connection. Spring wire hose clamps come in a variety of sizes to accommodate various sizes of hoses which have numerous applications, e.g., water systems, air systems, vacuum systems, hydraulic systems and pneumatic systems.

The hose clamp pliers designed for use with spring wire hose clamps typically have grooves or notches in the head or jaws for receiving the terminal ears. However, these types of pliers generally cannot be used on a double ring spring wire hose clamp having a loop end bent radially outward and another terminal end bent radially upward consisting of the two ears of the looped spring wire extending through the loop of the looped end.

Pliers are typically used to compress the ends of a looped spring wire hose clamp. However, problems are often encountered when an individual attempts to use pliers on such a clamp. Such problems include slippage of the pliers from the clamp, twisting of the ends of the clamp, the inability to place the pliers at an angle convenient to properly compress the ends together, or a combination of these problems. As will be understood, pliers work, but they are not ideally suited for the installation or removal of spring wire clamps of this design.

Other known devices attempt to alleviate the "slipping" problem by using a pair of recesses to accommodate an item to be grasped by the device. However, the recesses are all of the same size and thus, can result in a smaller end of the item slipping even though a larger end of the item may be secure.

Accordingly it is an object of the present invention to provide an improved reversible hose clamp tool that is adapted to receive the upward extending ears of a double ring spring wire hose clamp which has a looped end bent radially outward and another terminal end consisting of the two ears of the looped spring wire extending through the loop of the looped spring end and bent radially upward. It is another object of present invention to provide a reversible hose clamp tool that can be used in a variety of positions when installing and removing spring wire hose clamps. It is a further object of the present invention to provide a reversible hose clamp tool which can be used to accommodate a variety of sizes of spring wire hose clamps. Still another object of the present invention is to provide a reversible hose clamp tool that overcomes the problems of the hose clamp twisting or slipping off the pliers during installation and removal. A further object of the present invention is to provide a reversible hose clamp tool which is convenient and easy to use. A final object of the present invention is to provide a reversible hose clamp tool which is simple to manufacture and affordable for the majority of users. Other objects and features will be in part apparent and in part pointed out hereinafter.

The invention accordingly comprises the product hereinafter described, the scope of the invention being indicated by the following claims.

SUMMARY OF THE INVENTION

The present invention resembles pliers and operates similarly thereto. It consists of a pair of elongated main members, each of which has a handle section, a pivot section and a jaw section.

The pivot section contains a pivot bore to pivotally join the pair of main members with a pivot pin. As with conventional pliers, the handle sections are used to cause the main members to rotate about the pivot pin and thus cause the jaw sections of an assembled tool to move closer or further apart from each other.

The jaw section comprises a head end and sides, each of which contains first and second generally rectangular cutouts. These cutouts are located along a front edge of the head end and laterally within the jaw section along an inside edge of its side. The first cutouts are large enough to receive the first end (i.e., the loop end) of the double ring spring wire hose clamp. The second cutouts are large enough to receive the second end (i.e., the ears) or radially bent ends of the double ring spring wire hose clamp but are not large enough to accommodate the first end of the double ring spring wire hose clamp. The second cutouts are centered along the length of the first, larger cutouts. This allows each of the first cutouts to provide two landings, one on each side of their respective second cutouts, that are adapted to accept the first end of the double ring spring wire hose clamp while permitting the second end of the double ring spring wire hose clamp to fit between the landings and contact the second cutouts when the device is in use. The present invention allows the diameter of the hose clamp to be increased for installation or removal when the reversible hose clamp tool is in the closed position. Since the head end and sides all have both first and second generally rectangular cutouts, a device made in accordance with the invention is both reversible and can be used in a variety of positions.

In use, the ears and loop end of a double ring spring wire hose clamp are placed within the jaws of the present invention. The handle sections are squeezed together which, in turn, close the jaws of the device which compress the ends of the clamp and cause the diameter of the clamp to increase for installation. When the clamp is suitably placed, the ends of the clamp are released thereby permitting the clamp to return to its original diameter and completing installation. To remove the clamp, one reverses the operation. As will be appreciated, the clamp is conveniently and easily installed or removed from any direction desired or required without the slippage that can occur with ordinary pliers or the breakage of the ends of the clamp.

DETAILED DESCRIPTION OF THE DRAWINGS

Figure 1:
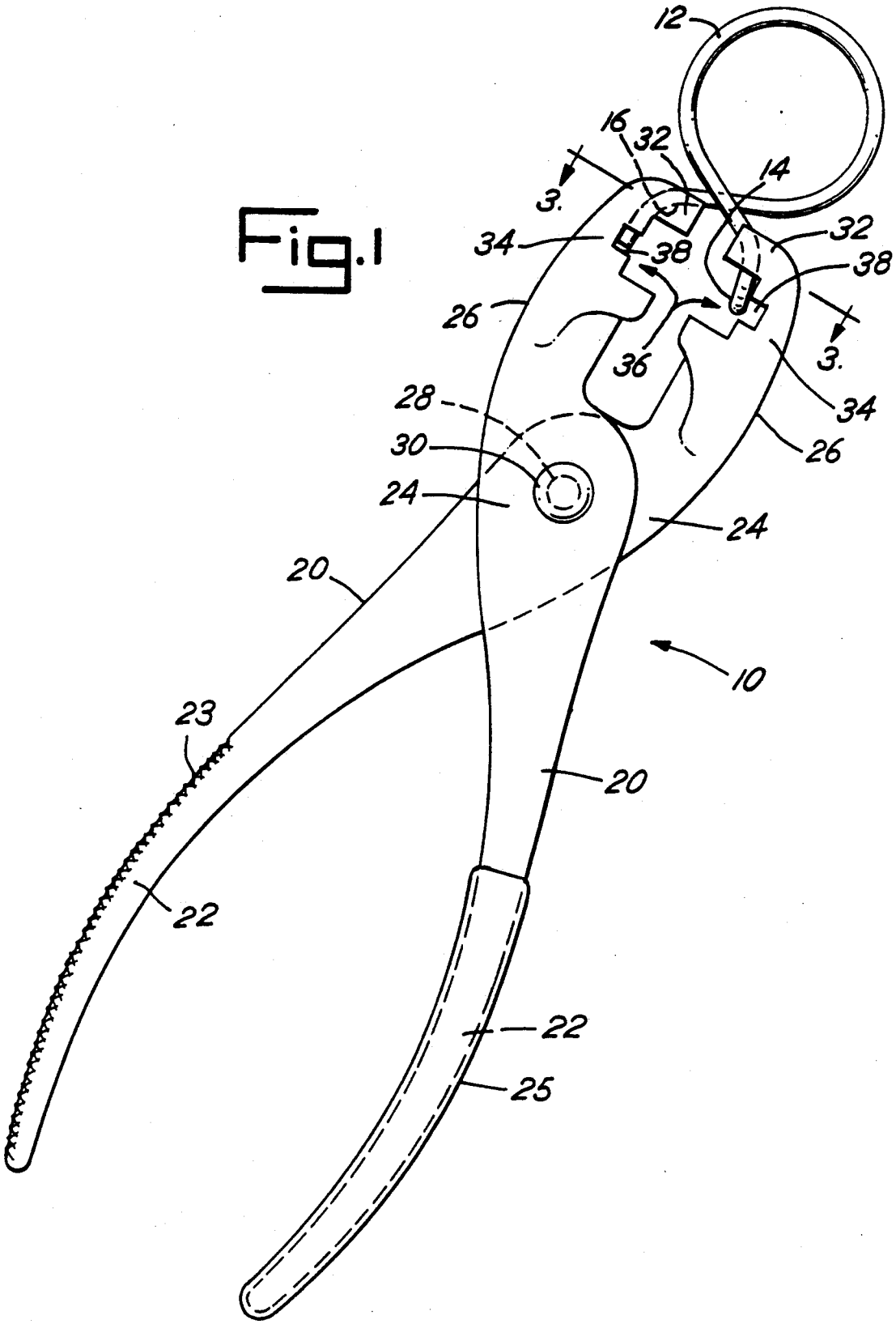
FIG. 1 is a plane view showing the reversible hose clamp tool of the present invention.

Referring now to the drawings wherein like reference characters represent like elements, FIG. 1 shows a double ring spring wire hose clamp 12 located in the jaws of reversible hose clamp tool 10 of this invention. Reversible hose clamp tool 10 is designed to compress hose clamp 12 which has a first end or loop end 14 bent radially outward and a second end or ears 16. The ears 16 are comprised of the two blunt ends of the double ring spring wire hose clamp bent radially upward. The two radially bent ears 16 and loop end 14 are used to expand hose clamp 12. Hose clamp 12 is installed or moved onto a hose 18 (see FIG. 5) by compressing or squeezing ears 16 and loop end 14 together thereby increasing the diameter of the ring portion of hose clamp 12. Hose clamp 12 can then be slipped over hose 18 and moved to the desired clamping position. Ears 16 and loop end 14 are then released to allow hose clamp 12 to tighten or clamp around hose 18.

Preferably, reversible hose clamp tool 10 contains a pair of elongated tool members 20. Each elongated tool member 20 has a handle section 22, a pivot section 24 and a jaw section 26. Handle section 22 of tool member 20 is elongated to provide leverage to ease operation and to provide comfort for the user. If desired, handle section 22 may be patterned, knurled or otherwise treated to provide an improved gripping surface for the user. It can also be provided with a cushion coating which not only provides a protective grip for the handle but also provides a more comfortable grip for the user.

Pivot section 24 is located between handle section 22 and jaw section 26 and contains a pivot bore 28. A pivot pin 30 extends through pivot bore 28 in section 24 of each elongated tool member 20 thereby pivotally joining the pair of elongated tool members 20. Pivot pin 30 can be any of numerous known connecting pins, such as a bolt and nut, a rivet or any other type of pivotable connective device. Pivot bore 28 is properly sized to receive pivot pin 30.

Jaw section 26 extends beyond pivot section 24 and contains a head end 32 and sides 34. In another embodiment not shown, jaw section 26 can extend from pivot section 24 at an angle. This will allow a user to approach the installation of hose clamp 12 from an angle. In some instances, this will allow better observation of hose clamp 12 during installation, movement or removal of the hose clamp.

Head end 32 and sides 34 of jaw section 26 all contain a first generally rectangular cutout 36 and a second generally rectangular cutout 38. The first and second generally rectangular cutouts, 36 and 38, respectively, are disposed along an inside front edge of head end 32 and laterally through sides 34 along an inside edge of sides 34. The first generally rectangular cutouts 36 are designed to receive the first end or loop end 14 of double ring spring wire hose clamp 12. The second generally rectangular cutouts 38 are designed to receive the second end or ears 16 of the double ring spring wire hose clamp 12. The second generally rectangular cutouts 38 are not large enough to accommodate the first end 14 of the double ring spring wire hose clamp 12. All three of the first rectangular cutouts 36, one on the head end 32 and two on the sides 34, have the same dimensions. Further, all three of the second rectangular cutouts 38, one on the head end 32 and two on the sides, have the same dimensions.

Figure 2:
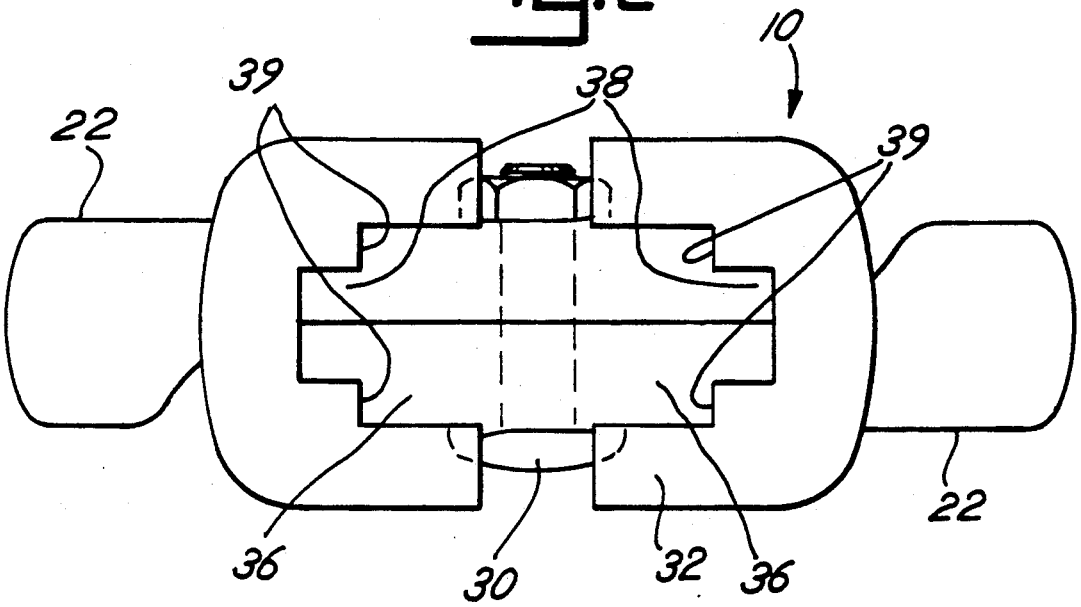
FIG. 2 is a top view of the present invention showing the head of the jaws.

FIG. 2 shows clamp tool 10 from a position overlooking the top of the tool. Head end 32 is shown in an open position allowing a view of pivot pin 30, seen in phantom, pivotally joining a pair of elongated members 20. Elongated tool members 20 are joined such that first and second generally rectangular cutouts, 36 and 38, form cross-shaped openings when reversible hose clamp tool 10 is in a closed position.

FIG. 2 also shows first and second generally rectangular cutouts, 36 and 38, in head end 32. The second generally rectangular cutout 38 has a smaller length than the first generally rectangular cutout 36 and is substantially centered along the length of the first generally rectangular cutout 36. This allows each of the first generally rectangular cutouts 36 to provide two equal landings 39, one on each side of their respective second generally rectangular cutouts 38. Each set of two landings 39 is adapted to accept the first end 14 of the double ring spring wire hose clamp 12. Also, each set of two landings 39 is spaced such that the second end 16 of the double ring spring wire hose clamp 12 fits between the two landings 39. When in the closed position, the radially bent ears 16 and loop end 14 of the hose clamp 12 are compressed or squeezed together thereby expanding hose clamp 12 for installation or removal. Since the head end 32 and each jaw section 26 have both first and second generally rectangular cutouts, 36 and 38, respectively, the reversible hose clamp tool is, in fact, reversible. Thus, when one picks up the reversible hose clamp tool 10 for use, its orientation does not matter since either jaw section 26 has areas capable of accommodating both the first end 14 and the second end 16 of the double ring spring wire hose clamp 12.

Figure 3:
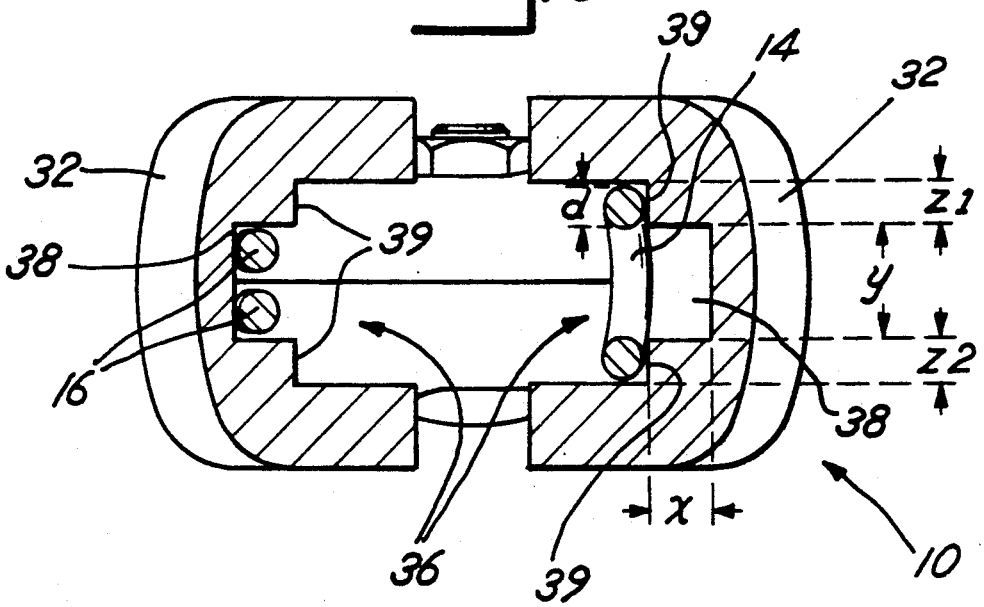
FIG. 3 is a cross sectional view of the head end of the device of the present invention showing how a double ring spring wire hose clamp is gripped.

FIG. 3 shows the first end 14 and the second end 16 of the double ring spring wire hose clamp 12 gripped within first and second generally rectangular cutouts, 36 and 38, of head end 32 along line 3—3 of FIG. 1. As shown, the first generally rectangular cutout 36, via its two landings 39, accommodates the first end 14 of the double ring spring wire hose clamp 12 while the second generally rectangular cutout 38 accommodates the second end 16 of the double ring spring wire hose clamp 12. Preferably, the dimensions z1 and z2 and x are all equal to each other. Also, the dimension y is greater than twice the dimension d. Finally, z1, and therefore z2 and x, are all greater than d. In terms ranges, each of the two landings 39 should have a length (z1 and z2) longer than the diameter of the wire (d) that is used to form the double ring spring wire hose clamp 12. However, the length (z1 and z2) of the two landings 39 must be small enough so that the distance between the two landings 39 (i.e., y, which is the length of the second rectangular cutout 38) is large enough to accommodate the second end 16 of the double ring spring wire hose clamp 12 as explained above. Further, the depth (x) of the second rectangular cutout 38 must be greater than the diameter (d) of the wire. These guidelines for the dimensions of the first and second rectangular cutouts, 36 and 38, respectively, and the two landings 39 allow the reversible hose clamp tool 10 to grasp both the first end 14 and the second end 16 of the double ring spring wire hose clamp 12 as securely as possible.

Figure 4:
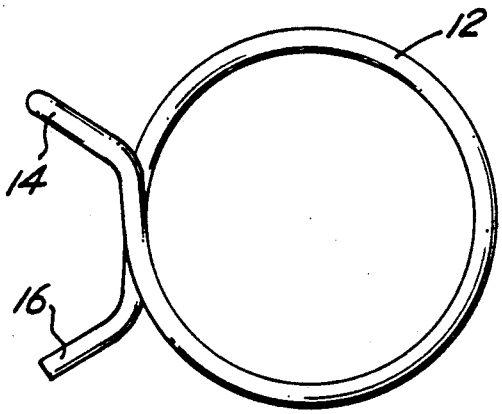
FIG. 4 is a side view of a spring wire hose clamp.
Figure 5:
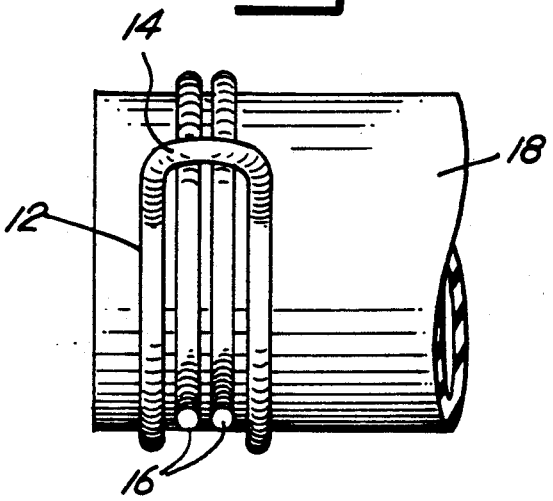
FIG. 5 is a view showing a double ring spring wire hose clamp on a hose.

FIGS. 4 and 5 more clearly show double ring spring wire hose clamp 12 and its application on hose 18. Ears 16 will be seen to project through the loop of loop end 14.

Figure 6:
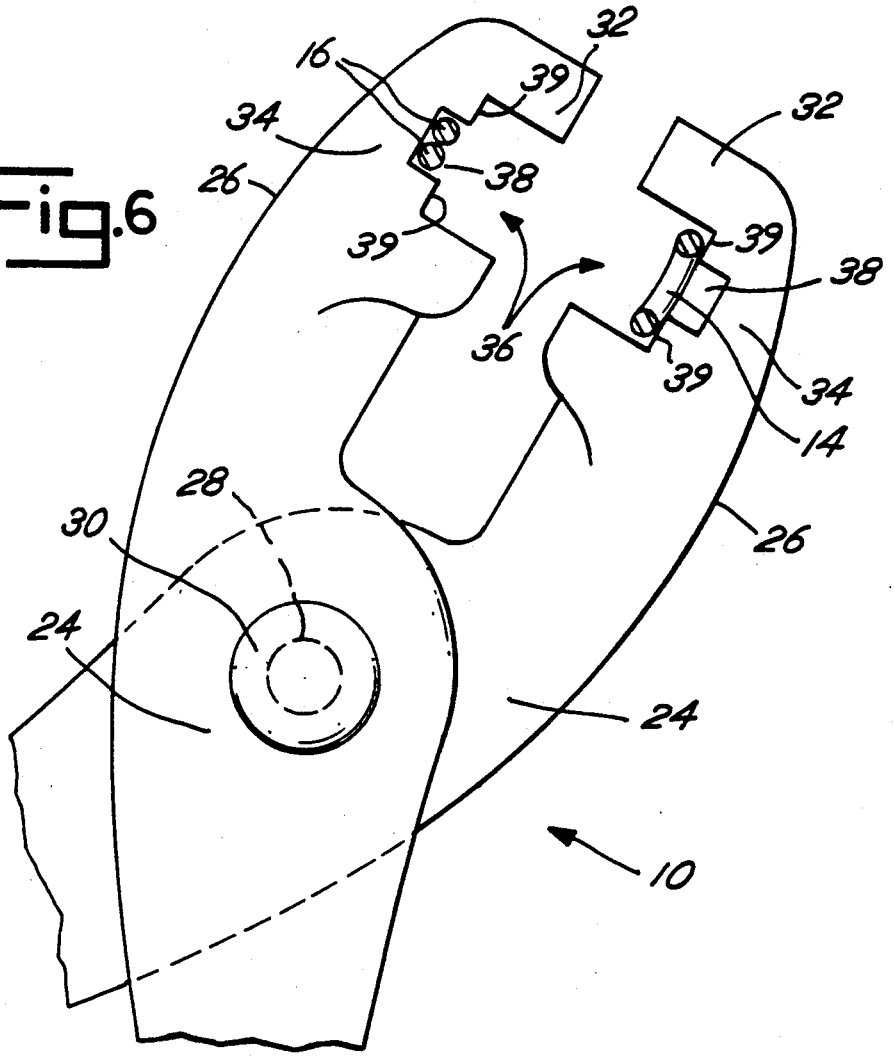
FIG. 6 is a partial side of the device of the present invention wherein a double ring spring wire hose clamp, shown in cross section, is gripped by the device.

FIG. 6 shows the first end 14 and the second end 16 of the double ring spring wire hose clamp 12 gripped within first and second generally rectangular cutouts, 36 and 38, of sides 34. As shown, the first generally rectangular cutout 36, via its two landings 39, accommodates the first end 14 of the double ring spring wire hose clamp 12 while the second generally rectangular cutout 38 accommodates the second end 16 of the double ring spring wire hose clamp 12.

In operation, double ring spring wire hose clamp 12 is gripped by placing the radially bent ears 16 and loop end 14 in one of the sets of first and second generally rectangular cutouts, 36 and 38. Loop end 14 and ears 16 can be placed in the first and second generally rectangular cutouts, 36 and 38, respectively, on either the head end 32 of jaw section 26 or on sides 34 of jaw section 26. The position of hose clamp 12 and/or the needs of the user will determine which pair of first and second generally rectangular cutouts, 36 and 38, are used. Handle sections 22 are then squeezed together. As handle sections 22 are brought together, jaw section 26 compresses the radially bent ears 16 and loop end 14. This causes an increase in the diameter of hose clamp 12 so that hose clamp 12 can be slipped over hose 18 and moved to the desired clamping position. Ears 16 and loop end 14 are then released by allowing handle sections 22 to separate thereby allowing ears 16 and loop end 14 to return to a position which reduces the diameter of hose clamp 12 and permits clamp 12 to tighten around hose 18.

As will be apparent from an examination of the drawings and the accompanying description, the present invention will provide an improved reversible hose clamp tool for use with double ring spring wire hose clamps which can be used in a variety of positions when installing and removing any of a number of sizes of double ring spring wire hose clamps. Additionally the device overcomes the problems associated with slippage encountered when inappropriate tools are used and breakage of the clamps. Lastly it will be seen that the device is convenient and easy to use, simple to manufacture, and affordable for the majority of users.

As various changes could be made in the above product without departing from the scope of the invention, it is intended that all matter contained in the above description or shown in the accompanying drawings shall be interpreted as illustrative and not in a limiting sense.

What is claimed is:

1. A reversible hose clamp tool comprising:

(a) a pair of main members, each main member having a handle section, a pivot section and a jaw section, each pivot section having a pivot bore, each jaw section having a head end and two sides, each head end and each of the two sides having, along a front edge and laterally along an inside edge, respectively:

(i) a first generally rectangular cutout; and (ii) a second generally rectangular cutout, the second generally rectangular cutout having a smaller length than the first generally rectangular cutout and being substantially centered along the length of the first generally rectangular cutout to form two landings of the first generally rectangular cutout;

(b) means for pivoting the main members, the means for pivoting extending through the pivot bore of the pivot section of the pair of main members and pivotally joining the pair of main members whereby the first and second generally rectangular cutouts of one jaw section oppose the first and second generally rectangular cutouts of the other jaw section when the reversible hose clamp tool is in a closed position resulting in three generally cross-shaped openings.

2. The reversible hose clamp tool of claim 1 wherein the jaw sections extend from the pivot sections at an angle.

3. The reversible hose clamp tool of claim 1 wherein the means for pivoting is comprised of a bolt and nut.

4. The reversible hose clamp tool of claim 1 wherein the means for pivoting is a rivet.

5. The reversible hose clamp tool of claim 1 wherein the handle section is coated with a protective covering for the comfort of the user.

6. The reversible hose clamp tool of claim 1 wherein the handle section is provided with a surface treatment which provides an improved gripping surface.

* * * * *